US010410582B2

(12) United States Patent
Lee et al.

(10) Patent No.: US 10,410,582 B2
(45) Date of Patent: Sep. 10, 2019

(54) DISPLAY PANEL AND DISPLAY DEVICE INCLUDING DISPLAY PANEL

(71) Applicant: Samsung Display Co., Ltd., Yongin-si (KR)

(72) Inventors: Jae-Sic Lee, Seoul (KR); Jung-Hoon Shim, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 92 days.

(21) Appl. No.: 15/626,172

(22) Filed: Jun. 19, 2017

(65) Prior Publication Data

US 2018/0012542 A1 Jan. 11, 2018

(30) Foreign Application Priority Data

Jul. 7, 2016 (KR) ..... 10-2016-0086283

(51) Int. Cl.

*G09G 3/3233* (2016.01)
*G09G 3/3266* (2016.01)
*G09G 3/3275* (2016.01)

(52) U.S. Cl.

CPC ..... *G09G 3/3233* (2013.01); *G09G 3/3266* (2013.01); *G09G 3/3275* (2013.01); *G09G 2300/0413* (2013.01); *G09G 2310/0291* (2013.01); *G09G 2330/08* (2013.01); *G09G 2330/10* (2013.01)

(58) Field of Classification Search

CPC combination set(s) only.
See application file for complete search history.

(56) References Cited

U.S. PATENT DOCUMENTS

| | | | | |
|---|---|---|---|---|
| 8,059,071 | B2 | 11/2011 | Kim et al. | |
| 8,178,865 | B2 * | 5/2012 | Jeong | G09G 3/006 257/350 |
| 8,330,691 | B2 * | 12/2012 | Tanimoto | G02F 1/136286 345/92 |
| 9,286,832 | B2 | 3/2016 | Park et al. | |
| 9,576,546 | B2 * | 2/2017 | Lee | G09G 3/3688 |
| 2007/0124633 | A1 * | 5/2007 | Kim | G09G 3/2003 714/726 |
| 2009/0015572 | A1 * | 1/2009 | Matsui | G09G 3/006 345/204 |
| 2009/0207110 | A1 * | 8/2009 | Lee | G09G 3/2022 345/82 |

(Continued)

FOREIGN PATENT DOCUMENTS

| | | |
|---|---|---|
| KR | 10-0739335 | 7/2007 |
| KR | 10-2015-0117358 | 10/2015 |

*Primary Examiner* — Kenneth Bukowski
(74) *Attorney, Agent, or Firm* — H.C. Park & Associates, PLC

(57) ABSTRACT

A display panel includes a displaying area including pixels, a non-displaying area including a dummy pixel, and a switching circuit to transfer a data signal to the dummy pixel in response to a control signal. The display panel may compensate for defective pixels located in different data lines using only one dummy pixel column and may minimize an area (e.g., a dead space) including the dummy pixel column by including a distributor buffering a signal of an output line and a switching circuit selecting/providing a portion of a signal of the output line to a dummy data line.

15 Claims, 8 Drawing Sheets

(56) References Cited

U.S. PATENT DOCUMENTS

2013/0141314 A1* 6/2013 Ka ..... G09G 3/006 345/55
2014/0240304 A1* 8/2014 In ..... G09G 3/3233 345/212
2014/0240372 A1* 8/2014 Pak ..... G09G 3/3233 345/690
2014/0313106 A1* 10/2014 In ..... G09G 3/3233 345/76
2015/0022513 A1* 1/2015 Kim ..... G09G 3/3225 345/212
2015/0084014 A1* 3/2015 Kim ..... H01L 27/3276 257/40
2015/0087081 A1* 3/2015 Kim ..... H01L 27/3223 438/4
2015/0102312 A1* 4/2015 Lee ..... G09G 3/3233 257/40
2015/0103103 A1* 4/2015 Kim ..... G09G 3/3233 345/690
2015/0109189 A1* 4/2015 Hwang ..... G09G 3/3225 345/78
2015/0123884 A1* 5/2015 Kim ..... G09G 3/006 345/77
2015/0161931 A1* 6/2015 Lee ..... G09G 3/3266 345/77
2015/0170562 A1* 6/2015 In ..... G09G 3/2029 345/80
2016/0163243 A1* 6/2016 Park ..... G09G 3/3258 345/205
2016/0189644 A1* 6/2016 So ..... G09G 3/3233 345/205
2016/0372535 A1* 12/2016 Lee ..... H01L 27/3276

* cited by examiner

DISPLAY PANEL AND DISPLAY DEVICE INCLUDING DISPLAY PANEL

CROSS-REFERENCE TO RELATED APPLICATION

This application claims priority from and the benefit of Korean Patent Application No. 10-2016-0086283, filed on Jul. 7, 2016, which is hereby incorporated by reference for all purposes as if fully set forth herein.

BACKGROUND

Field

Exemplary embodiments relate to a display device. More particularly, exemplary embodiments of the present inventive concept relate to a display panel to repair a defective pixel and a display device.

Discussion of the Background

A display panel includes pixels which do not operate when a defect or disconnection of a transistor included in a pixel occurs. Recently, display panels have further included dummy pixels and may display an image by using a dummy pixel instead of a pixel having a defect (e.g., a defective pixel).

A display device may provide data signals to the display panel using a de-multiplexer for reducing costs (or manufacturing cost of the display device). For example, the display device may sequentially provide three data signals (e.g., red, green, and blue data signals or R/G/B data signals) from a driving integrated circuit to a 1:3 de-multiplexer (or a de-multiplexer having one input terminal and three output terminal) through one output line, and the 1:3 de-multiplexer provides the data signals to three sub pixels (e.g., three sub pixels included in the same pixel row). Here, the display device requires three dummy pixels (or three dummy pixel columns) to account for a possible defect of each of the three sub pixels. Therefore, a region (or a dead space) including the dummy pixels is widened (or increases).

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a display panel having a minimized region in which a dummy pixel is located for repairing a defective pixel.

Exemplary embodiments also provide a display device including the display panel.

Additional aspects will be set forth in the detailed description which follows, and, in part, will be apparent from the disclosure, or may be learned by practice of the inventive concept.

An exemplary embodiment discloses a display panel that includes a displaying area including pixels; a non-displaying area including a dummy pixel; and a switching circuit configured to transfer a data signal to the dummy pixel in response to a control signal.

An exemplary embodiment also discloses a display panel that includes a first pixel row including a first pixel, a second pixel, and a dummy pixel; a distributor configured to sequentially receive a first data signal and a second data signal through an output line, to provide the first data signal to the first pixel through a first data line in a first period in response to a first control signal, to provide the second data signal to the second pixel through a second data line in a second period in response to a second control signal, and to buffer a signal of the output line; and a switching circuit electrically connected between the distributor and the dummy pixel and configured to provide the signal of the output line to the dummy pixel through a dummy data line in response to a third control signal.

An exemplary embodiment further discloses a display device that includes a display panel including a first pixel row, the first pixel row including a first pixel, a second pixel, and a dummy pixel; a data driver configured to sequentially output a first data signal and a second data signal through an output line; a distributor configured to sequentially receive the first data signal and the second data signal through the output line, to provide the first data signal to the first pixel through a first data line in a first period in response to a first control signal, to provide the second data signal to the second pixel through a second data line in a second period in response to a second control signal, and to buffer a signal of the output line; and a switching circuit electrically connected between the distributor and the dummy pixel and configured to provide the signal of the output line to the dummy pixel through a dummy data line in response to a third control signal.

Therefore, a display panel according to exemplary embodiments may compensate for defective pixels located in different data lines using only one dummy pixel column and may minimize an area (e.g., a dead space) including the dummy pixel column by including a distributor buffering a signal of an output line and a switching circuit selecting/providing a portion of a signal of the output line to a dummy data line (or a dummy pixel included in the dummy pixel column).

In addition, a display device according to an exemplary embodiment may minimize an area (e.g., a dead space) of a display panel in which a dummy pixel is located by buffering a signal of an output line and by selecting/providing a portion of the signal of the output line to a dummy data line (or the dummy pixel)

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
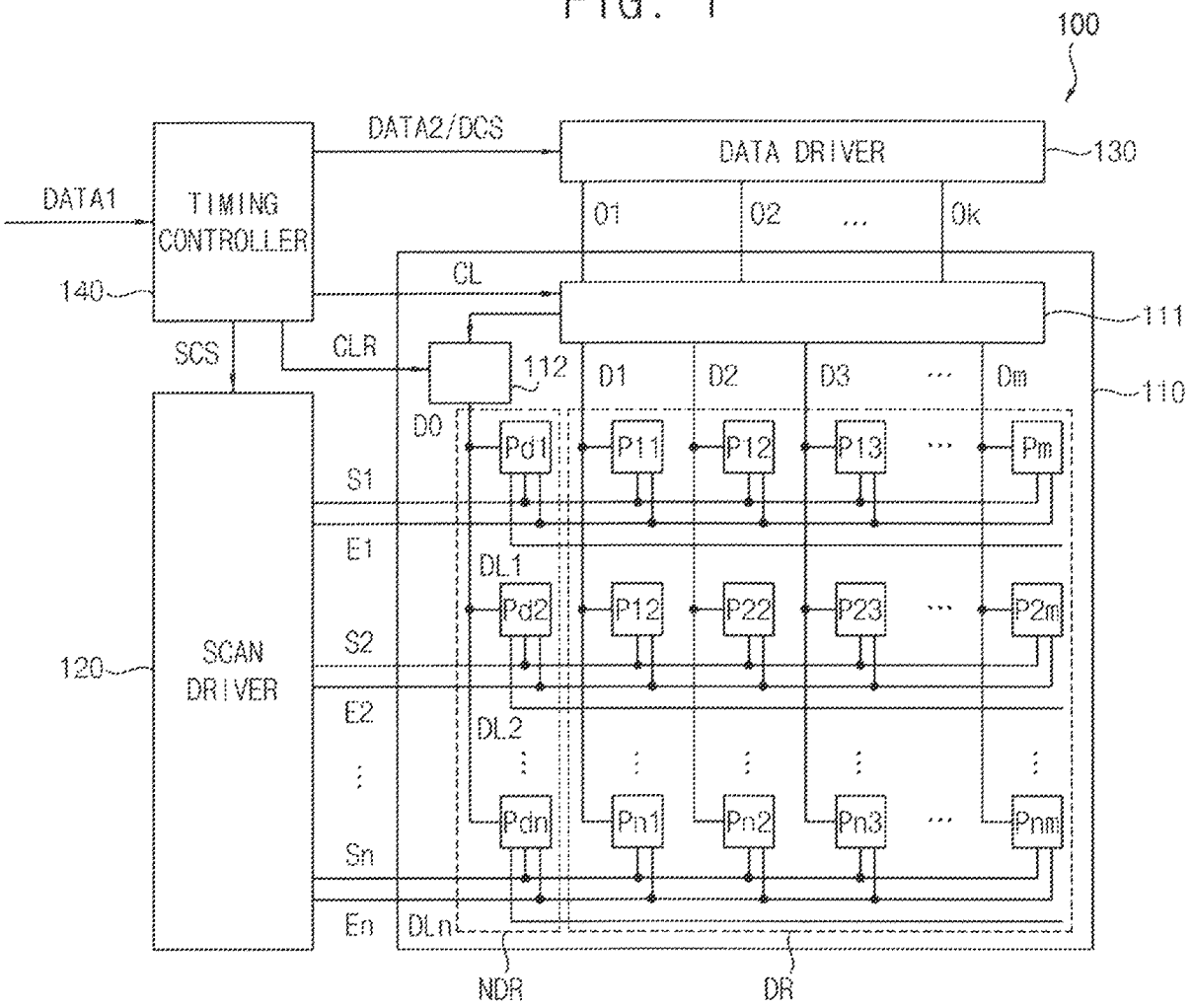
FIG. 1 is a block diagram illustrating a display device according to an exemplary embodiment.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Hereinafter, the present inventive concept will be explained in detail with reference to the accompanying drawings.

FIG. 1 is a block diagram illustrating a display device according to an exemplary embodiment.

Referring to FIG. 1, the display device 100 may include a display panel 110, a scan driver 120, a data driver 130, and a timing controller 140. The display device 100 may display an image based on input data (e.g., first data DATA1) provided from an external component. For example, the display device 100 may be an organic light emitting display device.

The display panel 110 may include data lines D1 through Dm, a dummy data line D0, scan lines S1 through Sn, light emission control signal lines E1 through En, dummy lines DL1 through DLn (or repairing lines), pixels P11 through Pnm, dummy pixels Pd1 through Pdm, a distributor 111, and a switching circuit 112, where each of m and n is a positive integer. The pixels P11 through Pnm may be included in a displaying region DR (or an active area), and the dummy pixels Pd1 through Pdm may be included in a non-displaying region NDR (or a non-active area).

The distributor 111 may distribute data signals provided from the data driver 130 through output lines O1 through Ok to the data lines D1 through Dm, where k is a positive integer. For example, the distributor 111 may include a 1:3 de-multiplexer (e.g., a de-multiplexer including one input terminal and three output terminals), and may sequentially receive first through third data signals through a first output line O1. Here, the distributor may provide the first data signal to a eleventh pixel P11 through a first data line D1 in response to a first control signal in a first period, may provide the second data signal to a twelfth pixel P12 through a second data line D2 in response to a second control signal in a second period, and may provide the third data signal to a thirteenth pixel P13 through a third data line D1 in response to a third control signal in a third period. Here, the first through third periods may be included in a same data period but may not overlap each other (e.g., none of the first through third periods may occur simultaneously). The first through third control signals may be included in a control signal CL.

For example, when the display panel 110 (or the display device 100) includes the distributor 111, a number of output lines O1 through Ok (or a number of pads, e.g., k), which is electrically connect the display panel 110 and the data driver 130, may be reduced, and a number of driving circuits (or, a number of channels) included in the data driver 130 may be reduced. Therefore, manufacturing cost of the display device 100 may be reduced.

In an exemplary embodiment, the distributor 111 may buffer (or copy) and output a signal of a certain output line. For example, when one of the eleventh pixel P11 through the thirteenth pixel P13 is defective, the distributor 111 may buffer and output data signals provided through the first output line O1.

The switching circuit 112 may be electrically connected between the distributor 111 and the dummy pixels Pd1 through Pdm and may provide the signal of the certain output line (e.g., a signal of a certain output line that are buffered or copied by the distributor 111) to the dummy pixels Pd1 through Pdm through the dummy data line D0 in response to a fourth control signal CLR (e.g., a repairing control signal). Here, the fourth control signal CLR may control the switching circuit 112 to be operated corresponding to a time point at which a data signal is provided to a certain pixel (e.g., a pixel corresponding to a certain dummy pixel). An operation of the switching circuit 112 based on the fourth control signal CLR will be described with reference to FIG. 4B.

The pixels P11 through Pnm may be electrically connected to the data lines D1 through Dm, the scan lines S1 through Sn, the light emission control signal lines E1 through En, and the dummy lines DL1 through DLn. Each of the pixels P11 through Pnm may store a data signal (e.g., a data signal provided through the data lines D1 through Dm) in response to a scan signal (e.g., a scan signal provided through the scan lines S1 through Sn) and may emit light with a luminance corresponding to the data signal and in response to a light emission control signal (e.g., a light emission control signal provided through the light emission control signal lines E1 through En).

The dummy pixels Pd1 through Pdm may be electrically connected to the dummy data line D0, the scan lines S1 through Sn, the light emission control signal lines E1 through En, and the dummy lines DL1 through DLn. The dummy pixels Pd1 through Pdm may be included in a dummy pixel column corresponding to the dummy data lines D0.

The dummy lines DL1 through DLn may electrically connect the pixels P11 through Pnm to the dummy pixels Pd1 through Pdm. For example, a first dummy line DL1 may electrically connect one of the eleventh pixel P11 through mth pixel Pm to the first dummy pixel Pd1.

A configuration of the pixels P11 through Pnm, a configuration of the dummy pixels Pd1 through Pdm, and a connection structure of the dummy lines DL1 through DLn will be described in detail with reference to FIG. 2B.

The scan driver 120 may generate a scan signal based on a scan driving control signal SCS. The scan driving control signal SCS may include a start signal (or a start pulse) and clock signals, and the scan driver 120 may include gate driving units (or shift registers) sequentially generating the scan signal based on the start signal and the clock signals.

The scan driver 120 may generate the light emission control signal based on a dimming signal (or a light emission driving control signal) and may provide the light emission control signal to the display panel 110 through the light emission control signal lines E1 through En. Here, each of the pixels P11 through Pnm may emit no light in response to the light emission control signal having a logic high level and may emit light in response to the light emission control signal having a logic low level.

The data driver 130 may generate the data signal corresponding to converted data (e.g., second data DATA2) using reference gamma voltages and may provide the data signal to the display panel 110 through the output lines O1 through Ok. The data driver 130 may sequentially output certain data signals (e.g., first through third data signals) to a certain output line (e.g., the first output line O1) because the display panel 110 (or the display device 100) includes the distributor 111.

The timing controller 140 may convert the input data to be used by the data driver 130, control the scan driver 120, and control the data driver 130. For example, the timing controller 140 may generate the data driving control signal DCS and may provide the converted data (e.g., the second data DATA2) and the data driving control signal DCS to the data driver 130. The timing controller 140 may generate and provide the scan driving control signal SCS to the scan driver 120. The timing controller 140 may generate and provide the control signal CL (or the first through third control signal) and the fourth control signal CL (or the repairing control signal) to the display panel 110.

The display device 100 may further include a power supply. The power supply may generate a driving voltage to drive the display device 100. The driving voltage may include a first power voltage ELVDD and a second power voltage ELVSS.

As illustrated in FIG. 1, the distributor 111 and the switching circuit 112 are included in the display panel 110. However, the distributor 111 and the switching circuit 112 are not limited thereto. For example, each of the distributor 111 and the switching circuit 112 may be implemented as an independent circuit (or an integrated circuit) and may be electrically connected between the data driver 130 and the display panel 110.

Hereinafter, assuming that the thirteenth pixel P13 is defective, a configuration of the display device 100 (or a configuration of the display panel 110) will be described.

Figure 2A:
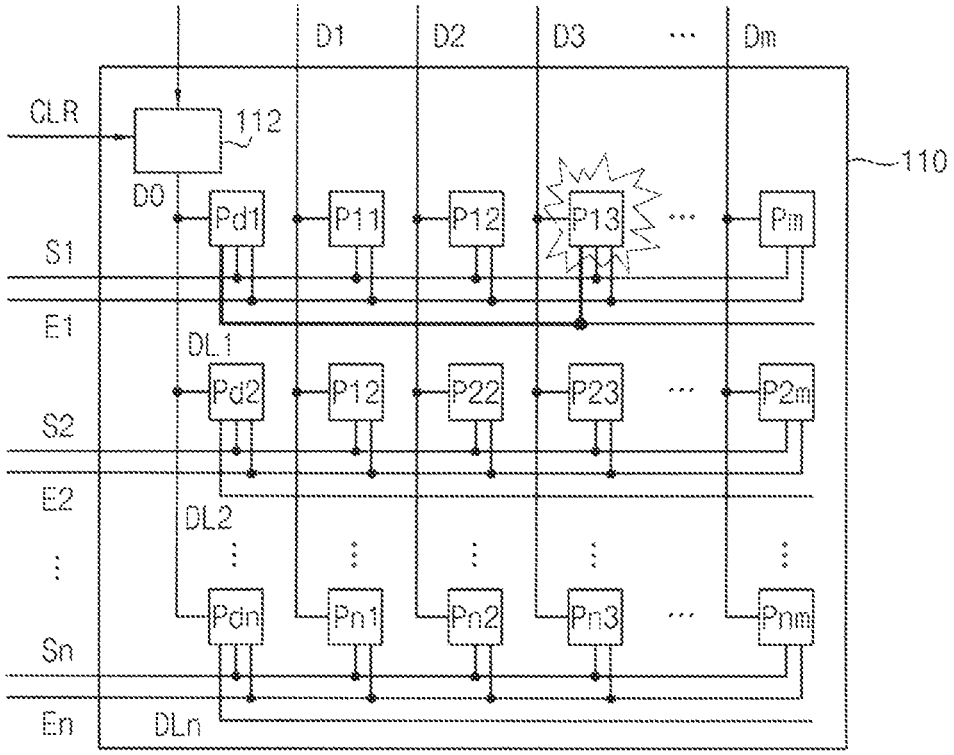
FIG. 2A is a block diagram illustrating an example of a display panel included in the display device of FIG. 1.

FIG. 2A is a block diagram illustrating an example of a display panel included in the display device of FIG. 1. FIG. 2B is a diagram illustrating an example of a pixel and a dummy pixel included in the display panel of FIG. 2A.

Figure 2B:
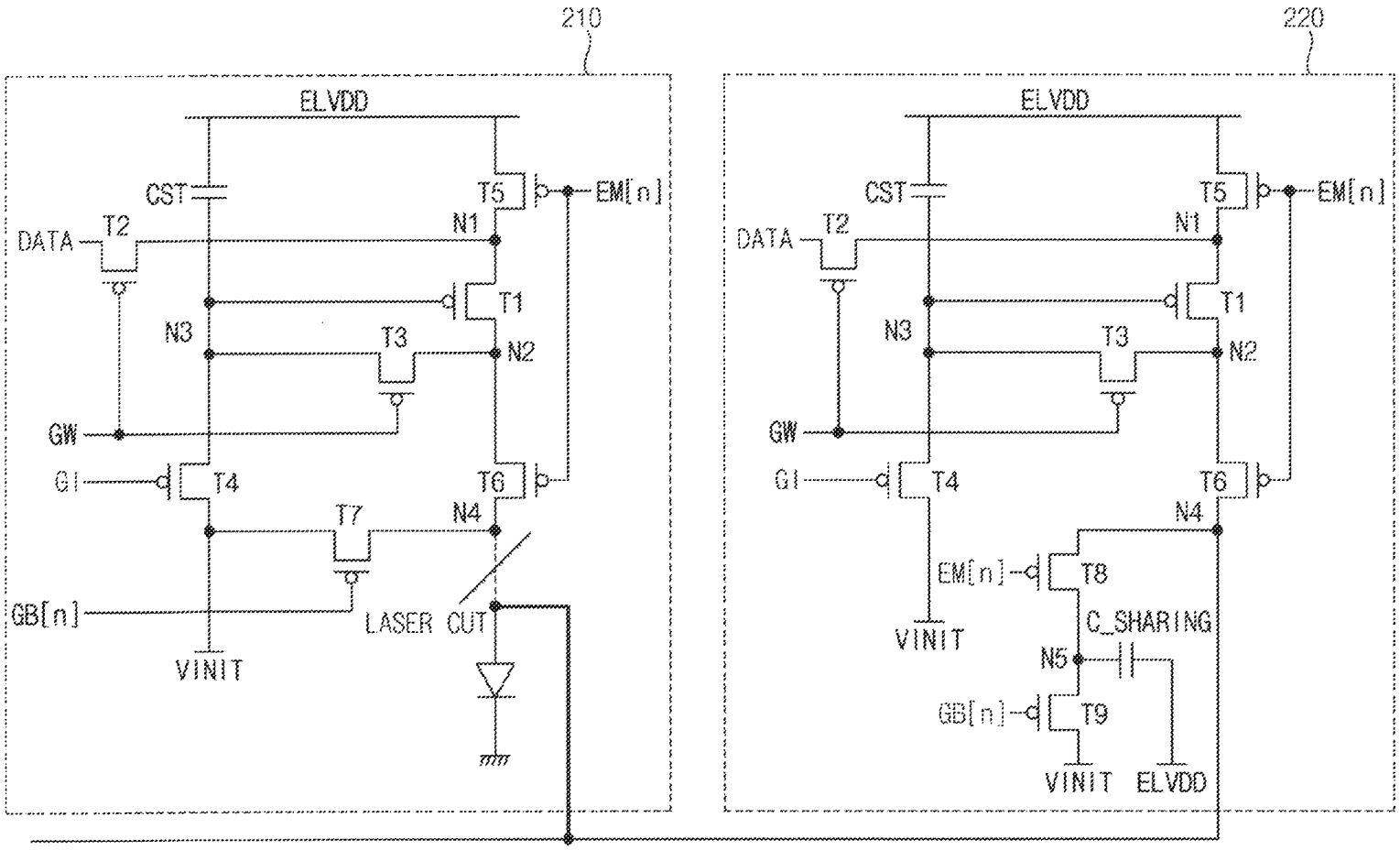
FIG. 2B is a diagram illustrating an example of a pixel and a dummy pixel included in the display panel of FIG. 2A.

Referring to FIGS. 1, 2A, and 2B, the thirteenth pixel P13 may be electrically connected to the first dummy pixel Pd1 through the first dummy line DL1 when the thirteenth pixel P13 has a defect. Hereinafter, a configuration of the thirteenth pixel P13 and a configuration of the first dummy pixel Pd1 will be described.

A first pixel 210 illustrated in FIG. 2B may be an example of the thirteenth pixel P13 illustrated in FIG. 2A, and a dummy pixel 220 illustrated in FIG. 2B may be an example of the first dummy pixel Pd1 illustrated in FIG. 2A.

The first pixel 210 may include a light emission element EL, a storage capacitor Cst, and first through seventh transistors T1 through T7. That is, the first pixel 210 may have a structure of 7T1C.

The light emission element EL may be electrically connected between the first power voltage ELVDD (or a fourth node N4) and the second power voltage ELVSS, and may emit light based on a first driving current flowing through the fourth node N4. For example, the light emission element EL may be an organic light emitting diode.

The second transistor T2 may include a first electrode electrically connected to a third data line D3, a second electrode electrically connected to a first node N1, and a gate electrode receiving a scan signal GW. The second transistor T2 may transfer the data signal DATA (e.g., a third data signal) to the first node N1 in response to the scan signal GW.

The first transistor T1 may include a first electrode electrically connected to the first node N1, a second electrode electrically connected to a second node N2, and a gate electrode electrically connected to a third node N3. The first transistor T1 may control amount of a current provided to the light emission element EL in response to a third node voltage at the third node N3 (or a voltage stored or charged in the storage capacitor Cst).

The third transistor T3 may include a first electrode electrically connected to the second node N2, a second electrode electrically connected to the third node N3, and a gate electrode receiving the scan signal GW. The third transistor T3 may electrically connect the second node N2 and the third node N3 in response to the scan signal GW.

The storage capacitor Cst may be electrically connected between the first power voltage ELVDD and the third node N3 and may store the data signal DATA transferred through the first through third transistors T1 through T3.

The fourth transistor T4 may include a first electrode electrically connected to a third voltage VINIT, a second electrode electrically connected to the third node N3, and a gate electrode receiving a gate signal GI. The fourth transistor T4 may transfer the third voltage VINIT to the storage capacitor Cst in response to the gate signal GI. Here, the storage capacitor Cst may be initialized by the third voltage VINIT, or a signal stored in the storage capacitor Cst may be eliminated by the third voltage VINIT.

The fifth transistor T5 may include a first electrode electrically connected to the first power voltage ELVDD, a second electrode electrically connected to the first node N1, and a gate electrode receiving the light emission control signal EM. Similarly, the sixth transistor T6 may include a first electrode electrically connected to the second node N2, a second electrode electrically connected to the fourth node N4, and a gate electrode receiving the light emission control signal EM. The fifth and sixth transistors T5 and T6 may form a current flowing path between the first power voltage ELVDD and the light emission element EL in response to the light emission control signal EM.

The seventh transistor T7 may include a first electrode electrically connected to the fourth node N4, a second electrode electrically connected to the third voltage VINIT, and a gate electrode receiving a compensation control signal GB[n]. The seventh transistor T7 may provide the third voltage VINIT to the fourth node N4 in response to the compensation control signal GB[n].

The dummy pixel 220 may include the first through sixth transistor T1 through T6, an eighth transistor T8, a ninth transistor T9, and a sharing capacitor C_SHARING. The first through sixth transistor T1 through T6 may be the same as or substantially the same as the first through sixth transistor T1 through T6 included in the first pixel 210. Therefore, duplicated description will not be repeated.

The eighth transistor T8 may include a first electrode electrically connected to the fourth node N4, a second electrode electrically connected to a fifth node N5, and a gate electrode receiving the light emission control signal EM[n]. The ninth transistor T9 may include a first electrode electrically connected to the fifth node N5, a second electrode electrically connected to the third voltage VINIT, and a gate electrode receiving the compensation control signal GB[n]. The sharing capacitor C_SHARING may be electrically connected between the fifth node N5 and the first power voltage ELVDD. The ninth transistor T9 may transfer the third voltage VINIT to the fifth node N5 in response to the compensation control signal GB[n], the sharing capacitor C_SHARING may temporally store a node voltage at the fifth node N5, and the eighth transistor T8 may provide the fifth node N5 with the node voltage stored in the sharing capacitor C_SHARING in response to the light emission control signal EM[n].

When the first pixel 210 has a defect, for example, when one of the first through seventh transistor T1 through T7 of the first pixel 210 operates abnormally or when a disconnection occurs in the first pixel 210, the fourth node N4 of the first pixel 210 may be disconnected from the light emission element EL of the first pixel 210. For example, the fourth node N4 may be disconnected from the light emission element EL by an external device (e.g., a laser cutting device). After this, the light emission element (or anode of the light emission element) of the first pixel 210 may be electrically connected to the fourth node N4 of the dummy pixel 220 through the dummy line DL.

Here, the dummy pixel 220 may provide a driving current to the fourth node N4 in response to the data signal DATA provided through the dummy line D0 illustrated in FIG. 2A, and the driving current may be provided to the light emission element through the fourth node N4 of the dummy pixel 220 and the dummy line DL. Therefore, the first pixel 210 may operate normally (or may emit light) using the dummy pixel 220 (or using a driving circuit included in the dummy pixel 220) even though the first pixel 210 has a defect.

However, the dummy pixel 220 may be operated based not on a third data signal for the thirteenth pixel P13 but a first data signal (or a second data signal) because the display device 100 buffers (or copies) data signals (e.g., the first through third data signals provided through the first output line O1) using the distributor 111. Here, the first pixel 210 (or the thirteenth pixel P13) repaired by using the dummy pixel 220 may emit light with a luminance which is different from a luminance corresponding to the third data signal.

Therefore, the display device 100 according to an exemplary embodiment may provide a certain data signal among the data signals (e.g., the third data signals among buffered data signals) using the switching circuit 112.

Figure 3:
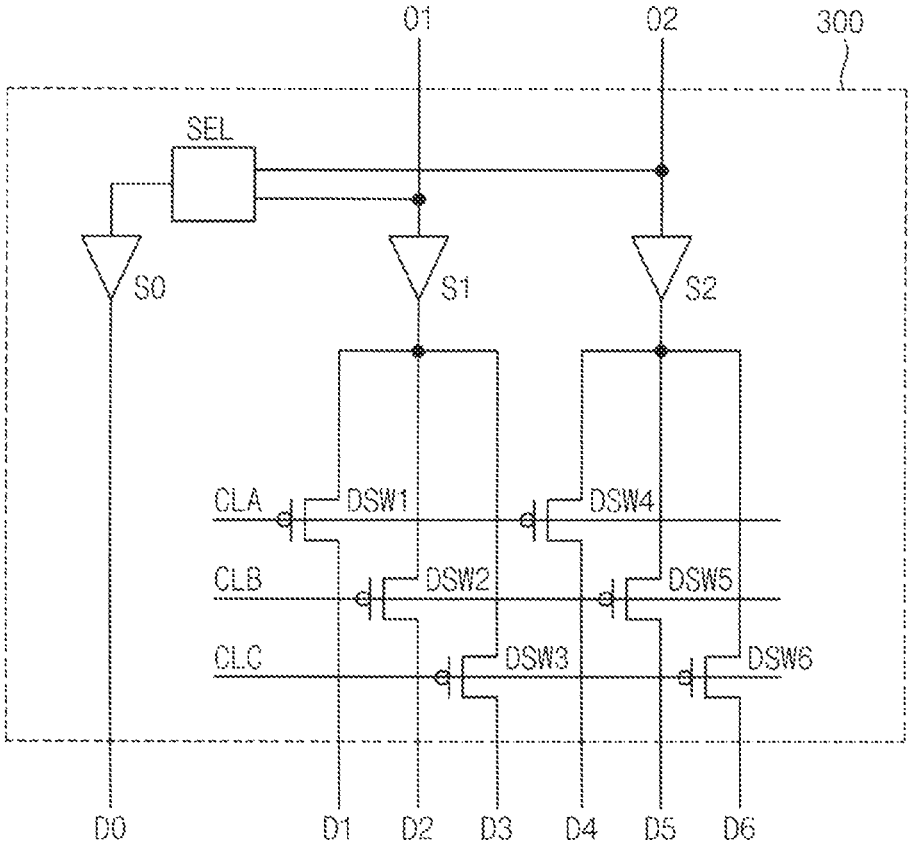
FIG. 3 is a diagram illustrating an example of a distributor included in the display device of FIG. 1.
Figure 4A:
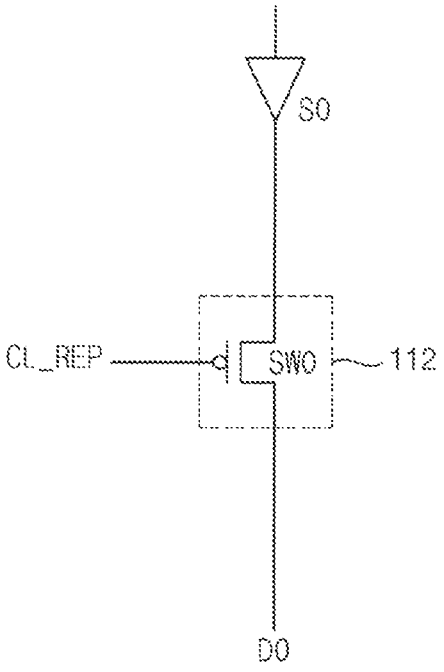
FIG. 4A is a diagram illustrating an example of a switching circuit included in the display device of FIG. 1.
Figure 4B:
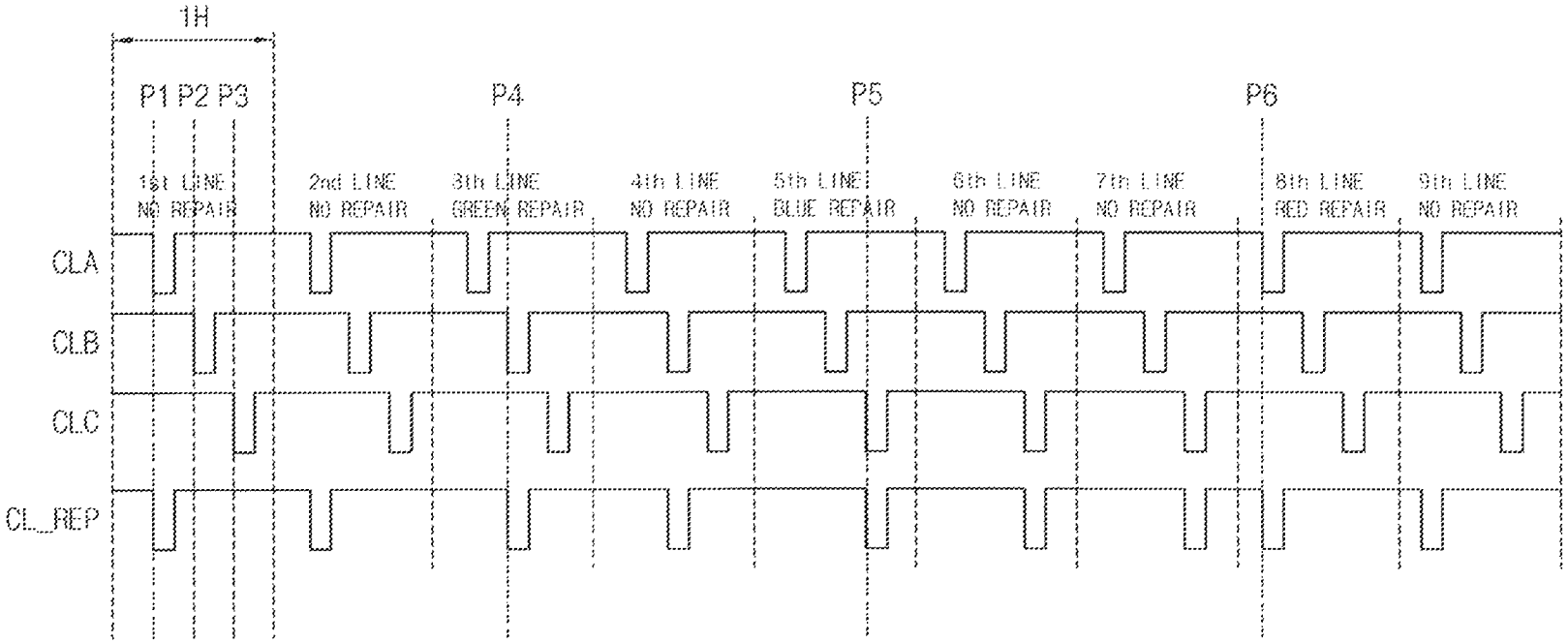
FIG. 4B is a waveform diagram describing an operation of the display device of FIG. 1.

FIG. 3 is a diagram illustrating an example of a distributor included in the display device of FIG. 1. FIG. 4A is a diagram illustrating an example of a switching circuit included in the display device of FIG. 1. FIG. 4B is a waveform diagram describing an operation of the display device of FIG. 1.

Referring to FIGS. 1 and 3, a distributor 300 (or a sub distributor) may be included in the distributor 111 illustrated in FIG. 1, and may include a first buffer S1, a second buffer S2, first through sixth distributing switches DSW1 through DSW6, a selector SEL, and a dummy amplifier S0 (or a dummy buffer).

The first buffer S1 may transfer data signals (e.g., first through third data signals) provided from the first output line O1 to the first through third distributing switches DSW1 through DSW3.

Similarly, the second buffer S2 may transfer data signals (e.g., fourth through sixth data signals) provided from a second output line O2 to the fourth through sixth distributing switches DSW4 through DSW6.

The first distributing switch DSW1 may be electrically connected between the first buffer S1 (or the first output line O1) and the first data line D1 and may be turned on in response to a first control signal CLA. For example, a first data signal may be provided through the first output line O1 in a first period. Here, the first distributing switch DSW1 may transfer the first data signal to the first data line D1 in response to the first control signal CLA having a logic low level (or a turn-on voltage level). Therefore, the eleventh pixel P11 (or a twenty-first pixel P21, an n1th pixel Pn1), which is illustrated in FIG. 1 and which is electrically connected to the first data line D1, may store the first data signal in the first period.

Similarly, the first distributing switch DSW2 may be electrically connected between the first buffer S1 (or the first output line O1) and a second data line D2 and may be turned on in response to a second control signal CLB. For example, a second data signal may be provided through the first output line O1 in a second period. Here, the second distributing switch DSW2 may transfer the second data signal to the second data line D2 in response to the second control signal CLB having a logic low level. Therefore, the twelfth pixel P12 (or a twenty-second pixel P22, an n2th pixel Pn2) which is electrically connected to the second data line D2 may store the second data signal in the second period.

Similarly, the third distributing switch DSW3 may be electrically connected between the first buffer S1 (or the first output line O1) and a third data line D3 and may be turned on in response to a third control signal CLC. For example, a third data signal may be provided through the first output line O1 in a third period. Here, the third distributing switch DSW3 may transfer the third data signal to the third data line D3 in response to the third control signal CLC having a logic low level. Therefore, the thirteenth pixel P13 (or a twenty-third pixel P23, an n3th pixel Pn3) which is electrically connected to the third data line D3 may store the third data signal in the third period.

The fourth through sixth distributing switches DSW4 through DSW6 may be the same as or substantially same as the first through third distributing switches DSW1 through DSW3. Therefore, duplicated description will not be repeated.

The selector SEL may be electrically connected between the output lines (e.g., the first output line O1 and the second output line O2) and the dummy amplifier S0 and may select one among the data signals (e.g., data signals provided through the first output line O1 or data signals provided through the second output line O2) and may provide the dummy amplifier S0 with the selected one among the data signals. The dummy amplifier S0 may buffer and provide the selected one among the data signals to the dummy data lines D0.

For example with reference to FIG. 2, the selector SEL may select and provide a data signal (or data signals) of the first output line O1 to the dummy amplifier S0 when the thirteenth pixel P13 has a defect. The dummy amplifier S0 may buffer the data signal of the first output line O1 and may provided the buffered data signal to the dummy data line D0.

As shown in FIG. 3, the distributor 300 is electrically connected to two output lines (e.g., the first and second output lines O1 and O2). However, the distributor 300 is not limited thereto. For example, the distributor 300 may be electrically connected to third through kth output lines O3 through Ok and may distribute data signals to sixth through mth data lines. For example, the distributor 300 may distribute data signals provided through the first output line O1 to the first and fourth data lines D1 and D4.

Referring to FIGS. 1, 3, and 4A, the switching circuit 112 may include a control switch SW0.

The control switch SW0 may be electrically connected between the dummy amplifier S0 and the dummy data line D0 (or the dummy pixels Pd1 through Pdn) and may be turned on in response to a fourth control signal CL_REP (or a repairing control signal). Here, the fourth control signal CL_REP may have a waveform which is the same as or substantially the same as a waveform of one (or a portion of one) selected from the first through third control signals CLA, CLB, and CLC for each time (e.g., in each horizontal time).

Referring to FIG. 4B, the first control signal CLA may have a logic low level during a certain time (e.g., during a first period) from a first time point P1 of a horizontal time 1H. The first control signal CLA may have a waveform which is repeated with a period of 1 horizontal time.

Similarly, the second control signal CLB may have the logic low level during a certain time (e.g., during a second period) from a second time point P2 of a horizontal time 1H, and the third control signal CLC may have the logic low level during a certain time (e.g., during a third period) from a third time point P3 of a horizontal time 1H. The second and third control signal CLB and CLC may have a waveform which is repeated with a period of 1 horizontal time, respectively.

During a first horizontal time, data signals (e.g., first through third data signals) for a first pixel row (e.g., a pixel row including the eleventh pixel P11 through the thirteenth pixel P13 illustrated in FIG. 1) may be provided to the distributor 111. As described with reference to FIG. 3, the distributor 111 may provide the first data signal to the eleventh pixel P11 in the first period (or, at the first time point P1) in response to the first control signal CLA, may provide the second data signal to the twelfth pixel P12 in the second period (or, at the second time point P2) in response to the second control signal CLB, and may provide the third data signal to the thirteenth pixel P13 in the third period (or, at the third time point P3) in response to the third control signal CLC.

During the first horizontal time, the fourth control signal CL_REP may have a waveform which is the same as or substantially the same as a waveform of the first control signal CLA. However, the fourth control signal is not limited thereto. For example, the fourth control signal CL_REP may have a logic high level (or a turn-off voltage level) or a waveform which is the same as or substantially the same as a waveform of the second control signal CLB (or the third control signal CLC) when the first pixel row has no defective pixel (or when the first dummy pixel Pd1 need no data signal).

For example, a thirty-second pixel P32 (e.g., a green pixel) of a third pixel row may have a defect, a fifty-third pixel P53 (e.g., a blue pixel) of a fifth pixel row may have a defect, and an eighty-first pixel P81 (e.g., a blue pixel) of an eighth pixel row may have a defect.

Here, the thirty-second pixel P32 may be electrically connected to a third dummy pixel Pd3 included in the third pixel row for repairing a defect of the thirty-second pixel P32. In addition, the fourth control signal CL_REP may have the logic low level at a fourth time point P4 similar to a waveform of the second control signal CLB because the second data signal (e.g., a green data signal) for the thirty-second pixel P32 is to be provided to the third dummy pixel Pd3. Therefore, only the second data signal among the first through third data signal may be provided to the third dummy pixel Pd3, the third dummy pixel Pd3 may provide the thirty-second pixel P32 with a driving current corresponding to the second data signal, and the thirty-second pixel P32 may normally emit light based on the driving current.

Similarly, the fifty-third pixel P53 may be electrically connected to a fifth dummy pixel Pd5 included in the fifth pixel row for repairing a defect of the fifty-third pixel P53. In addition, the fourth control signal CL_REP may have the logic low level at a fifth time point P5 similar to a waveform of the third control signal CLB because the third data signal (e.g., a blue data signal) for the fifty-third pixel P53 is to be provided to the fifth dummy pixel Pd5. Therefore, only the third data signal among the first through third data signal may be provided to the fifth dummy pixel Pd5, the fifth dummy pixel Pd5 may provide the fifty-third pixel P53 with a driving current corresponding to the third data signal, and the fifty-third pixel P53 may normally emit light based on the driving current.

Similarly, the eighty-first pixel P81 may be electrically connected to an eighth dummy pixel Pd8 included in the eighth pixel row for repairing a defect of the eighty-first pixel P81. In addition, the fourth control signal CL_REP may have the logic low level at a sixth time point P6 similar to a waveform of the first control signal CLA because the first data signal (e.g., a red data signal) for the eighty-first pixel P81 is to be provided to the eighth dummy pixel Pd8. Therefore, only the first data signal among the first through third data signal may be provided to the eighth dummy pixel Pd8, the eighth dummy pixel Pd8 may provide the eighty-first pixel P81 with a driving current corresponding to the first data signal, and the eighty-first pixel P81 may normally emit light based on the driving current.

As described with reference to FIGS. 3 through 4B, the display device 100 (or the display panel 110) according to exemplary embodiments may include the distributor 111 buffering a signal of an output line and the switching circuit 112 which selects and provide a portion of the signal of the output line to the dummy data line D0. Therefore, the display device 100 (or the display panel 110) may repair defective pixels on different data lines (or defective pixels electrically connected to different data lines) using only one dummy pixel column. That is, a region (or a dead space) in which the dummy pixel column is arranged may be minimized.

Figure 5A:
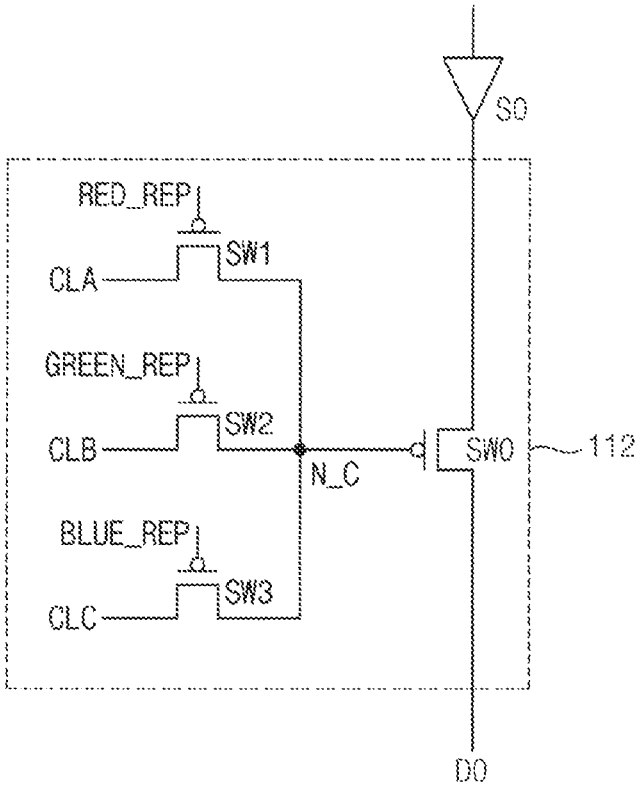
FIG. 5A is a diagram illustrating an example of a switching circuit included in the display device of FIG. 1.
Figure 5B:
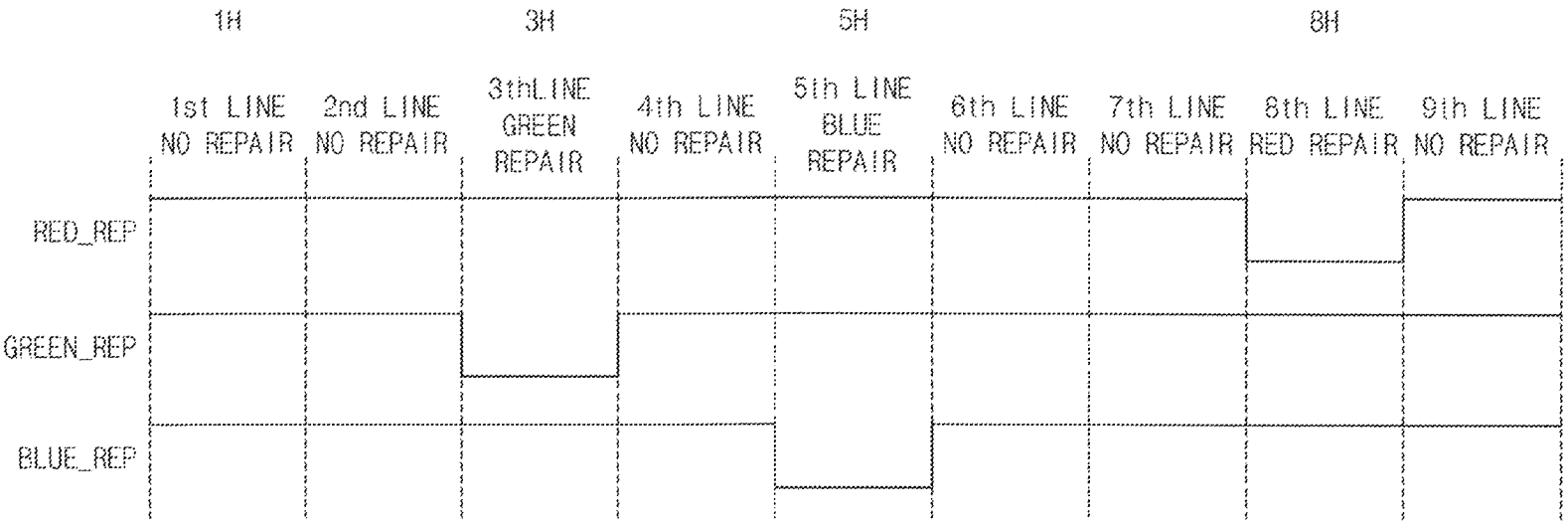
FIG. 5B is a waveform diagram describing an operation of the display device of FIG. 1.

FIG. 5A is a diagram illustrating an example of a switching circuit included in the display device of FIG. 1. FIG. 5B is a waveform diagram describing an operation of the display device of FIG. 1.

Referring to FIGS. 1 and 5A, the switching circuit 112 may include a control signal SW0 and first through third switches SW1, SW2, and SW3.

The control switch SW0 may be electrically connected between the dummy amplifier S0 and the dummy data line D0 (or the dummy pixels Pd1 through Pdn) and may be turned on in response to a voltage of a control node N_C.

The first switch SW1 may transfer the first control signal CLA to the control node N_C in response to a first sub control signal RED_REP, the second switch SW2 may transfer the second control signal CLB to the control node N_C in response to a second sub control signal GREEN_REP, and the third switch SW3 may transfer the third control signal CLC to the control node N_C in response to a third sub control signal BLUE_REP. The first though third sub control signals RED_REP, GREEN_REP, and BLUE_REP may be included in the fourth control signal CL_REP.

In an exemplary embodiment, the first though third sub control signals RED_REP, GREEN_REP, and BLUE_REP may be determined (or set) based on location information of a dummy pixel (e.g., based on a pixel row including the dummy pixel).

As above example with reference to FIG. the thirty-second pixel P32 (e.g., a green pixel) of the third pixel row may have a defect, the fifty-third pixel P53 (e.g., a blue pixel) of the fifth pixel row may have a defect, and the eighty-first pixel P81 (e.g., a blue pixel) of the eighth pixel row may have a defect. Here, as described with reference to FIG. 4B, the thirty-second pixel P32 may be electrically connected to the third dummy pixel Pd3 included in the third pixel row, the fifty-third pixel P53 may be electrically connected to the fifth dummy pixel Pd3 included in the third pixel row, and the eighty-first pixel P81 may be electrically connected to the eighth dummy pixel Pd8 included in the eighth pixel row.

Referring to FIGS. 4B and 5B, the second sub control signal GREEN_REP may have a logic low level during a third horizontal time 3H because the second data signal (e.g., a green data signal) for the thirty-second pixel P32 may be provided to the third dummy pixel Pd3. Here, the second switch SW2 may be turned on in response to the second sub control signal GREEN_REP, the second control signal CLB may be provided to the control node N_C, and the control switch SW0 may be turned on in response to the second control signal CLB at the fourth time point P4 (or, in the second period) described with reference to FIG. 4B. Therefore, only the second data signal among the first through third data signal may be provided to the third dummy pixel Pd3, the third dummy pixel Pd3 may provide the thirty-second pixel P32 with a driving current corresponding to the second data signal, and the thirty-second pixel P32 may normally emit light based on the driving current.

Similarly, the third sub control signal BLUE_REP may have a logic low level during a fifth horizontal time 5H because the third data signal (e.g., a blue data signal) for the fifty-third pixel P53 may be provided to the fifth dummy pixel Pd5. Here, the third switch SW3 may be turned on in response to the third sub control signal BLUE_REP, the third control signal CLC may be provided to the control node N_C, and the control switch SW0 may be turned on in response to the third control signal CLC at the fifth time point P5 (or, in the third period) described with reference to FIG. 4B. Therefore, only the third data signal among the first through third data signal may be provided to the fifth dummy pixel Pd5, the fifth dummy pixel Pd5 may provide the fifty-third pixel P53 with a driving current corresponding to the third data signal, and the fifty-third pixel P53 may normally emit light based on the driving current.

Similarly, the first sub control signal RED_REP may have a logic low level during a eighth horizontal time 5H because the first data signal (e.g., a red data signal) for the eighty-first pixel P81 may be provided to the eighth dummy pixel Pd8. Here, the first switch SW1 may be turned on in response to the first sub control signal RED_REP, the first control signal CLA may be provided to the control node N_C, and the control switch SW0 may be turned on in response to the first control signal CLA at the eighth time point P8 (or, in the first period) described with reference to FIG. 4B. Therefore, only the first data signal among the first through third data signal may be provided to the eighth dummy pixel Pd8, the eighth dummy pixel Pd8 may provide the eighty-first pixel P81 with a driving current corresponding to the first data signal, and the eighty-first pixel P81 may normally emit light based on the driving current.

As described with reference to FIGS. 5A and 5B, the switching circuit 112 may select and provide a portion of a signal of an output line to the dummy data line D0. Therefore, the display device 100 (or the display panel 110) may repair defective pixels on different data lines using only one dummy pixel column. That is, a region (or a dead space) in which the dummy pixel column is arranged may be minimized.

The present inventive concept may be applied to any display device (e.g., an organic light emitting display device, a liquid crystal display device, etc). For example, the present inventive concept may be applied to a television, a computer monitor, a laptop, a digital camera, a cellular phone, a smart phone, a personal digital assistant (PDA), a portable multimedia player (PMP), an MP3 player, a navigation system, a video phone, etc.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A display panel comprising:

a displaying area comprising a plurality of pixels;

a non-displaying area comprising a dummy pixel; and a switching circuit configured to transfer a data signal to the dummy pixel in response to a control signal, wherein:

the dummy pixel is electrically connected to a first pixel among the plurality of pixels through a dummy line;

the control signal controls the switching circuit to be operated when the data signal is provided to the first pixel;

the switching circuit comprises:

a control switch electrically connected to the dummy pixel and configured to be turned on in response to a voltage at a control node; and a first switch configured to transfer a second sub control signal to the control node in response to a first sub control signal, the second sub control signal activating the data signal; and the control signal comprises the first sub control signal and the second sub control signal.

2. The display panel of claim 1, wherein the first pixel comprises a light emission element, and wherein the dummy pixel is electrically connected to an anode of the light emission element through the dummy line and comprises a driving transistor to control an amount of a driving current provided to the light emission element based on the data signal.

3. The display panel of claim 1, wherein the switching circuit comprises:

a control switch electrically connected to the dummy pixel and configured to be turned on in response to the control signal.

4. The display panel of claim 1, wherein the first sub control signal is set based on a location information of the dummy pixel.

5. A display panel comprising:

a first pixel row comprising a first pixel, a second pixel, and a dummy pixel;

a distributor configured to sequentially receive a first data signal and a second data signal through an output line, to provide the first data signal to the first pixel through a first data line in a first period in response to a first control signal, to provide the second data signal to the second pixel through a second data line in a second period in response to a second control signal, and to buffer a signal of the output line; and a switching circuit electrically connected between the distributor and the dummy pixel and configured to provide the signal of the output line to the dummy pixel through a dummy data line in response to a third control signal, wherein:

the distributor comprises:

a first distributing switch electrically connected between the output line and the first data line and turned on in response to the first control signal;

a second distributing switch electrically connected between the output line and the second data line and turned on in response to the second control signal; and a dummy amplifier buffering the signal of the output line; and the switching circuit comprises a control switch electrically connected between the dummy amplifier and the dummy pixel and turned on in response to the third control signal.

6. The display panel of claim 5, wherein the display panel comprises a dummy line which electrically connects the dummy pixel to one of the first pixel and the second pixel.

7. The display panel of claim 6, wherein the first pixel includes a light emission element, and wherein the dummy pixel is electrically connected to an anode of the light emission element through the dummy line and comprises a driving transistor to control an amount of a driving current provided to the light emission element based on the first data signal.

8. The display panel of claim 5, wherein the third control signal has a turn-on voltage level in the first period when the dummy pixel is electrically connected to the first pixel, and wherein the third control signal has a turn-on voltage level in the second period when the dummy pixel is electrically connected to the second pixel.

9. A display panel comprising:

a first pixel row comprising a first pixel, a second pixel, and a dummy pixel;

a distributor configured to sequentially receive a first data signal and a second data signal through an output line, to provide the first data signal to the first pixel through a first data line in a first period in response to a first control signal, to provide the second data signal to the second pixel through a second data line in a second period in response to a second control signal, and to buffer a signal of the output line; and a switching circuit electrically connected between the distributor and the dummy pixel and configured to provide the signal of the output line to the dummy pixel through a dummy data line in response to a third control signal, wherein:

the distributor comprises:

a first distributing switch electrically connected between the output line and the first data line and turned on in response to the first control signal;

a second distributing switch electrically connected between the output line and the second data line and turned on in response to the second control signal; and a dummy amplifier buffering the signal of the output line;

the switching circuit comprises:

a control switch electrically connected between the dummy amplifier and the dummy pixel and configured to turned on in response to a voltage at a control node;

a first switch configured to transfer the first control signal to the control node in response to a first sub control signal; and a second switch configured to transfer the second control signal to the control node in response to a second sub control signal; and the third control signal comprises the first sub control signal and the second sub control signal.

10. The display panel of claim 9, wherein the first sub control signal and the second sub control signal are set based on location information of the dummy pixel.

11. The display panel of claim 9, wherein the first sub control signal has a turn-on voltage level, and the second sub control signal has a turn-off voltage level when the dummy pixel is electrically connected to the first pixel, and wherein the first sub control signal has a turn-off voltage level, and the second sub control signal has a turn-on voltage level when the dummy pixel is electrically connected to the second pixel.

12. A display device comprising:

a display panel including a first pixel row, the first pixel row comprising a first pixel, a second pixel, and a dummy pixel;

a data driver configured to sequentially output a first data signal and a second data signal through an output line;

a distributor configured to sequentially receive the first data signal and the second data signal through the output line, to provide the first data signal to the first pixel through a first data line in a first period in response to a first control signal, to provide the second data signal to the second pixel through a second data line in a second period in response to a second control signal, and to buffer a signal of the output line; and a switching circuit electrically connected between the distributor and the dummy pixel and configured to provide the signal of the output line to the dummy pixel through a dummy data line in response to a third control signal, wherein:

the distributor comprises:

a first distributing switch electrically connected between the output line and the first data line and turned on in response to the first control signal;

a second distributing switch electrically connected between the output line and the second data line and turned on in response to the second control signal; and a dummy amplifier buffering the signal of the output line; and the switching circuit comprises a control switch electrically connected between the dummy amplifier and the dummy pixel and turned on in response to the third control signal.

13. The display device of claim 12, wherein the display panel comprises a dummy line which electrically connects the dummy pixel to one of the first pixel and the second pixel.

14. The display device of claim 13, wherein the third control signal has a turn-on voltage level in the first period when the dummy pixel is electrically connected to the first pixel, and wherein the third control signal has a turn-on voltage level in the second period when the dummy pixel is electrically connected to the second pixel.

15. The display device of claim 12, further comprising:

a scan driver configured to provide a scan signal to the display panel, wherein the first pixel stores the first data signal in the first period in response to the scan signal, wherein the second pixel stores the second data signal in the second period in response to the scan signal, and wherein the dummy pixel stores the signal of the output line in response to the scan signal.

* * * * *